United States Patent [19]

Lee et al.

[11] Patent Number: 4,659,088

[45] Date of Patent: Apr. 21, 1987

[54] ELECTRONIC OPTICAL TARGET SYSTEM MOUNTED IN AN ENCLOSURE

[76] Inventors: Shirley L. Lee, 5017 Pleasant View Ave., Pocatello, Id. 83202; Michael H. Parish, Rte. 1, Box 1516; Gary C. Rogers, 210 Hillview Ave., both of Selah, Wash. 98942

[21] Appl. No.: 725,395

[22] Filed: Apr. 22, 1985

[51] Int. Cl.[4] ..... F41J 5/02

[52] U.S. Cl. ..... 273/310

[58] Field of Search ..... 273/1 E, 86 B, DIG. 28, 273/310, 311, 312; 434/21, 16, 20, 22

[56] References Cited

U.S. PATENT DOCUMENTS 4,266,776 5/1981 Goldfarb ..... 273/310
4,334,679 6/1982 Doyle et al. ..... 273/1 E
4,477,069 10/1984 Crudgington ..... 273/DIG. 28
4,533,144 8/1985 Juarez et al. ..... 273/310

FOREIGN PATENT DOCUMENTS 2046410 11/1980 United Kingdom ..... 434/20

*Primary Examiner*—Richard C. Pinkham
*Assistant Examiner*—Stuart W. Rose
*Attorney, Agent, or Firm*—Dowrey & Cross

[57] ABSTRACT

A domed game enclosure is provided for playing of an electronic game. A plurality of lights are mounted to the wall of the enclosure and arranged in a matrix. These lights are selectively lighted by a microcomputer. A sensor gun connected to the microcomputer is used by a player to detect light emitted by the lights. Acoustic signals are provided to the player to forewarn him of the approximate position of a light which is about to be lighted.

18 Claims, 8 Drawing Figures

FIG. 1
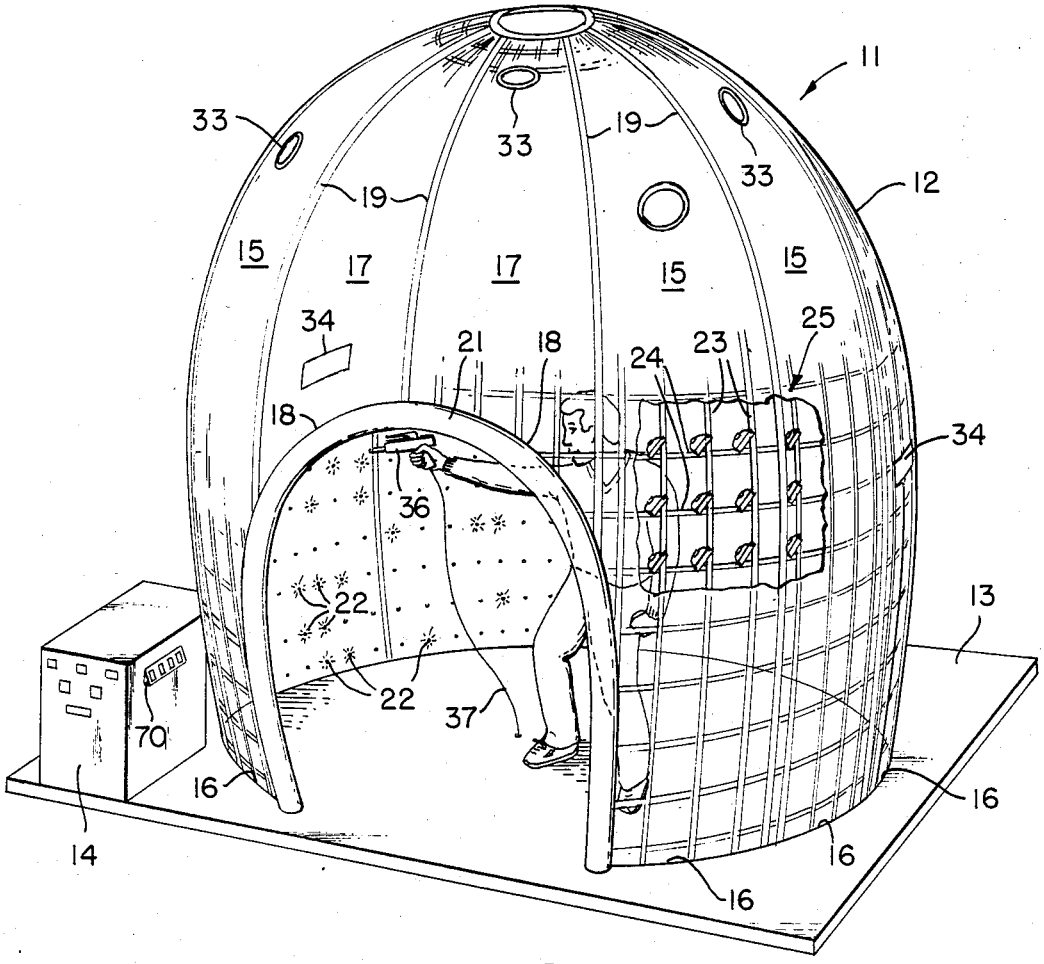
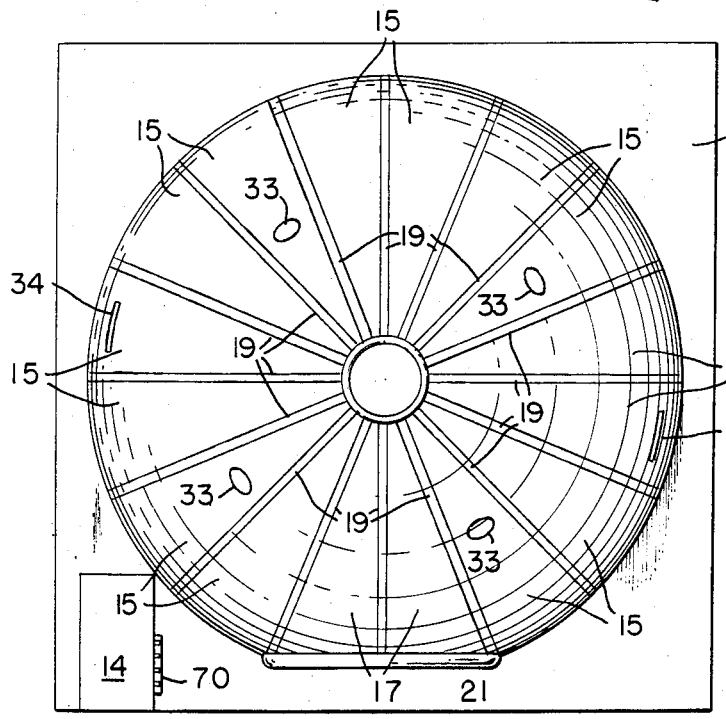
FIG. 2

ELECTRONIC OPTICAL TARGET SYSTEM MOUNTED IN AN ENCLOSURE

BACKGROUND OF THE INVENTION

1. Field of the Invention

The present invention relates to the field of electronic games. More particularly, the invention is directed to a domed game enclosure for playing of an electronic arcade type game.

2. Brief Description of the Prior Art

Over approximately the last decade, the most popular form of electronic arcade games has been of the type known as video games. In such games, a player stands or sits in front of a cathode ray tube type display screen and operates a series of controls. In most common games these controls includes joy-sticks, buttons, or sector balls. The controls are used for the purpose of moving an image around the screen to avoid other electronic images such as asteroids, monsters or obstacles or to attack a variety of such video images.

Video games have suffered from a number of failings that have contributed to a recent decline in their popularity. One of these failings is that persons interested in a game tend to gather around the game apparatus during play to watch the game as it proceeds. The relatively small video screen and the proximity to the machine at which the player is traditionally positioned generally require the bystanders to crowd around the player. This contributes to the discomfort of the player and makes it more difficult for him to concentrate on the game. In addition, such crowding is generally uncomfortable for the bystanders and does not always provide them with the desired view of the game.

Notwithstanding these difficulties, the viewing of the game by bystanders is important to the success of an arcade game. This is so because it attracts new players to try the game and allows experienced players to improve their skills by watching the successes of others. It is also important that a game be viewable by a prospective player or players awaiting a turn to play the game. An excessive delay during which such players must wait without being able to watch the progress of a game may result in such player becoming bored and deciding not to play the game. Attempts to avoid the crowding problem by seating the player in an enclosure having a generally transparent back have failed to alleviate the problems of crowding and merely result in more space being required for playing of the video game. In addition, these games generally render viewing of the game by bystanders more difficult.

A second failing of the current video games also results from the relatively small screen size. The screen is completely within the view of the player and any movement thereon is readily noticed. In addition, the sounds produced by the machine are generally for effect only and do not provide important information to the player. The player also remains in a relatively stationary position in front of the video display and is not required to move in any great extent during the play. As a result, the majority of the arcade video games involve merely arm or hand movements and visual perception. The auditory sense is not used as a part of play nor does the player become physically involved in the play, both of which would enhance the enjoyment in playing the game.

Some games have attempted to overcome this difficulty by providing additional display screens which require the player at least to turn his head or avert his eyes occasionally. Other games have provided sectors on the screen which provides a different view from the remainder of the screen, such as a rearview mirror section which provides a view to the rear in a driving game. These changes, however, still do not require him to respond to auditory signals or engage the player physically.

BRIEF DESCRIPTION OF THE INVENTION

The present invention overcomes these problems by providing a game which insulates the player from bystanders while providing bystanders with an excellent view of the playing of the game. In addition, the player is physically involved in playing the game, is provided with audible clues to aid in playing the game and, of course, must use the same kind of hand-eye coordination which has proved popular in conventional video games. This is accomplished by providing a domed game enclosure made of a generally transparent material which includes a number of active game elements spaced about its interior surface. The players of the game are thus surrounded by these active elements and cannot see more than a fraction of them at any one time. These active game elements may comprise electric lights, switches, sensors or a combination thereof. In one game, playable in the enclosure, the active elements comprise arrays of selectively activatable lights. In order to provide an indication of which lights are to be lighted, one or more of four speakers positioned about the dome are activated to provide an audible warning. Controls for playing the game are also positioned inside the dome. One such control comprises a simulated ray gun which, in association with the game control electronics, senses whether it is pointed at one of the illuminated lights at the time the trigger is pulled. The player must then turn toward the sound so that he will be ready to aim and activate a gun to "shoot" the light during the brief interval during which it is illuminated.

The acoustics of the dome are such that the location of the speaker from which a sound emanates is difficult unless the player is positioned in the center of the dome. Because of the acoustics of the dome, the player is forced to stand in the center of the enclosure to correctly perceive the audible clues. This further restricts the percentage of the dome he is able to view at any given time and renders the game more challenging.

In order to minimize the obscuring of play in the dome, and to provide a maximum number of lights at a minimum of costs, the lights are arranged in a plurality of matrices which include isolated conductive strips that permit the individual actuation of such lights without requiring a separate pair of wires for each of the lights. These matrices comprise a first plurality of conductive strips running generally horizontally and affixed to one surface of the domed enclosure and a second plurality of conductive strips disposed vertically on the other surface. In addition, a matrix of lights may be powered by concentrically disposed strips of the conductive material on one surface of the enclosure and radially extending strips on the other surface. The lights are thus activated, for example, by grounding one of the vertical or concentric strips and applying a voltage to one of the horizontal or radial strips. The light at the intersection of these two strips will then be illuminated. The power matrix could also be formed by imbedding wire in the clear plastic material of which the dome is made in patterns. In either case, the transparent material serves not only to separate the horizontal and vertical grid elements but also to insulate them from one another.

In order to facilitate shipping and moving, the dome may be formed in a plurality of curved segments the edges of which are machined to overlap to form a lap joint. The dome may be secured in its assembled form by means of screws of rivets extending through the overlapped edges or by other known joining means, Should it be desired to extend a light matrix over more than a single panel, the conductive strips or wires can be connected electrically by jumpers or connectors extending across the lap joint.

BRIEF DESCRIPTION OF THE DRAWINGS

FIG. 1 is a perspective view of the domed game enclosure with parts broken away.

FIG. 2 is a top view of the game enclosure of FIG. 1.

DETAILED DESCRIPTION OF THE PREFERRED EMBODIMENT

Figure 3:
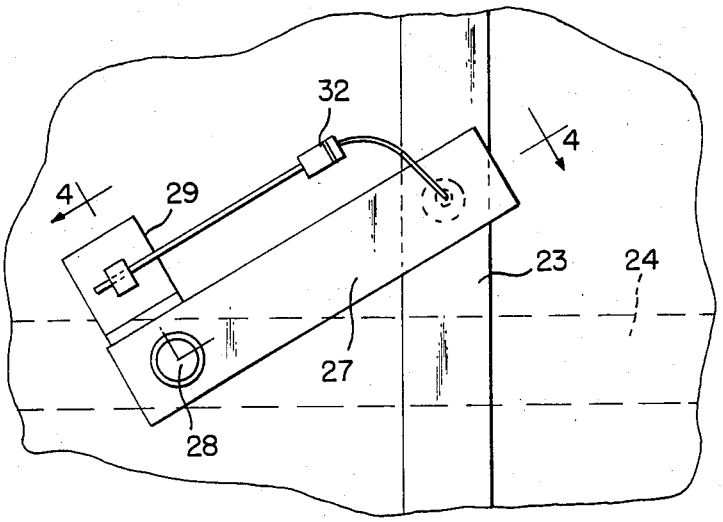
FIG. 3 is a side elevation of a portion of the wall of the game enclosure illustrating the connector which supplies power to an individual electric light from horizontal and vertical strips of conductive material.

As shown in FIGS. 1 and 2, the present invention provides a generally transparent, domed game enclosure 11 in which the player responds to audio and visual signals to play an electronic game. The game enclosue 11 isolates the player from bystanders and thus leaves him free to move. Since the walls of the dome are generally transparent, however, bystanders are afforded a clear view of the player from outside the dome. Players awaiting a turn to play the game thus have the opportunity to watch the game in play and thus do not become bored and walk away. In addition, new players are afforded an opportunity to learn about the game from watching it and are attracted to play it. The game enclosure 11 consists of a dome wall 12 mounted on a base 13. A control console 14 is mounted on the base 13 adjacent the dome wall 12 and contains the game control electronics.

The wall 12 of the game enclosure is prefrably made from a clear or colored transparent plastic material such as polycarbonate plastic. One such polycarbonate plastic which may be used is sold by the General Electric Company of Pittsfield, Mass. under the trademark "Lexan".

This plastic is available in clear, smoked and bronze colored transparent sheets any of which may be used for the dome wall 12. The wall 12 of the game enclosure 11 is mounted to a base 13, and may be maintained in position thereon by any of a variety of fasteners. One fastening system that may be used employs angle brackets (not shown) which are connected between the dome wall and the base by screws. This insures that the game enclosure 11 remains in proper position on the base 13 and that it retains it shape in the event that a player or bystander pushes against the dome wall 12.

The dome wall 12 may be formed out of a plurality of panels 15 cut from sheets of the polycarbonate plastic. As illustrated in FIGS. 1 and 2, these panels 15 have their maximum width along their lower edges 16 which rest on the base 13. The panels 15 extend upward from their lower edges 16 and narrow progressively toward the top.

Two additional panels 17 are used with the panel 15 to form an opening for entry and exit to the dome. The lower edges 18 of these panels 17 are cut in an arch to form an entrance to the dome. These panels 17 likewise become narrower toward their top. The panels 15, 17 are assembled to form the dome wall by overlapping the side edges 19 of successive panels and fastening them together, for example, with screws or rivets which extend through the overlapping edges 19.

When the dome wall 12 has been constructed and fastened to the base 16, a molding 21 is attached to the exposed edges of the dome wall 12 by such means as adhesives or riveting. This molding 21 is cushioned to prevent injury to players entering or leaving the game enclosure 11. The entryway formed by these arcuate edges 18 and the sides of the adjacent panels 14 should be as small as reasonably consistent with the comfortable entry and exit of the game enclosure 11 by players of the game.

Since polycarbonate plastic is capable of being thermoformed, the dome could also be constructed in three or four thermoformed sections. Such a procedure would reduce the number of overlapping edges 19 and reduce the labor involved in manufacture and erection of the dome wall 12.

Referring next to FIGS. 1–4, the interior of the dome is covered by a plurality of active elements. As illustrated in FIG. 1, these active elements may comprise a plurality of incandescent light bulbs 22 which are selectively activated during the course of the game. While it would be possible to provide power to each of these lights 22 by means of a discreet pair of wires, this would severely limit the number of lights that could be practically provided in the game enclosure 11. In addition, the presence of so many wires would materially detract from the appearance of the game and would interfere with the ability of bystanders to watch a game in progress. In order to avoid this problem, the lights 22 are positioned in a plurality of matrices 25. the lights 22 in these matrices 25 are positioned near the intersections of vertically and horizontally extending conductive strips 23, 24 which are mounted, respectively, on the external and internal wall 12 of the dome.

These conductive strips 23, 24 may be formed by applying an adhesive-backed conductive tape of the kind provided for application to store windows and the like for security purposes. Alternately, the metallic strips can be plated directly on to the plastic material by any of a variety of known processes such as chemical plating or flame spraying. In addition, the matrices 25 of conductors 23, 24 could be formed by embedding wires in the wall 12 of the dome 11. The conductive strips may be protected by spraying a coating of clear plastic over them after they have been applied to the dome wall 12. Suitable coating materials include polycarbonate plastic dissolved in a volatile solvent.

If it is necessary for one of the conductive strips 23, 24 to traverse the overlapping edges 19 of adjacent panels 14, a jumper can be provided by drilling holes through the panels 14 adjacent their edges so as to penetrate each of the conductive strips to be joined. A screw or rivet can be extended through each of these holes and secured in place. A wire can then be provided between these two fasteners to connect the conductive strips 23, 24 to be joined. In addition, although the section of a matrix 25 illustrated in FIG. 1 shows the horizontal and vertical strips 23, 24 as being disposed at right angles to one another, it will be appreciated that the strip 23 may also be applied to define a curve, for example to accommodate the entryway. In addition the strips may be discontinuous with proximate ends thereof jumpered together as described above. These patterns allow virtually the entire surface of the dome to be covered with matrices 25 to enhance the challenge of the game.

Figure 4:
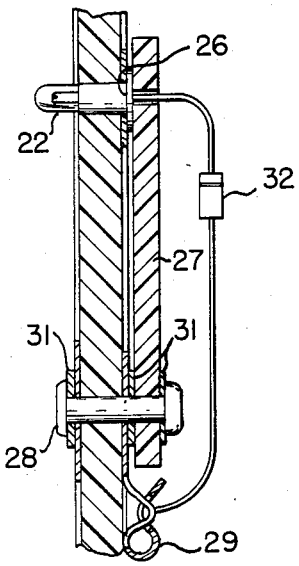
FIG. 4 is a cross-sectional view of the connector of FIG. 3.

Each light 22 in each matrix is electrically connected to one vertical strip 23 and one horizontal strip 24. As illustrated in FIGS. 3 and 4, the light 22 is mounted in an aperture which extends through both the vertical strip 23 and the dome wall 12. The base flange 26 of the lights 22 is larger than the aperture through which the light 22 extends. The light 22 is maintained in position with its base flange 26 in contact with the vertical strip by means of a resilient arm 27 which may be pivoted to a position behind the light. This arm 27 is made of a nonconductive material such as polycarbonate plastic and is pivotedly mounted to the dome wall 12 by means of a rivet 28 which extends there through. The rivet also extends through the horizontal conductive strip 24 and makes electrical contact therewith.

A spring clip 29 is mounted between the wall 12 and the resilient arm 27 and is in electrical contact with the rivet 28. A plurality of washers 31 are provided between the dome wall 12, the arm 27 and the head of the rivet 28 to permit the resilient arm 27 to pivot freely. Electrical contact to the center tap of the light 22 is made by means of a diode 32 one lead of which is retained in the spring clip 29 and the other lead of which extends through an aperture in the resilient arm 27.

Figure 7:
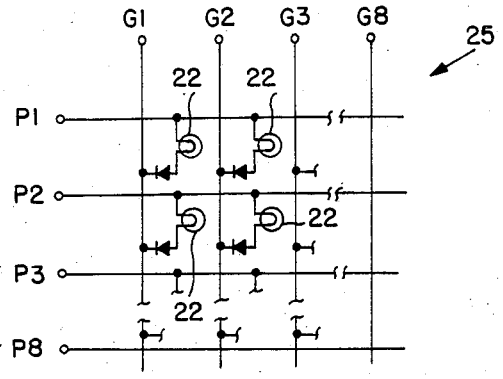
FIG. 7 is an electrical schematic of a matrix of conductive strips with parts broken away.

Although each light 22 is associated with a single vertical strip 23 and a single horizontal strip 23, as shown in FIGS. 1 and 7, each of the vertical and horizontal strips provides power or ground to approximately 16 lights 22. Thus, an array of 16 vertical conductive strips 23 and 16 horizontal conductive strips 24 can be associated with as many as 256 lights 22. Since the diodes 32 associated with each light 22 prevent current flow in one direction, a single lamp in the array may be lighted by selectively supplying a positive voltage to the associated horizontal strip 24 and grounding the corresponding vertical strip 23. In this manner, a large number of lights 22 may be controlled by a relatively small number of vertical and horizontal conductive strips 23, 24.

Five such matrices 25 are provided on the dome wall, one matrix 25 being provided at the top of the dome and four additional matrices 25 being spaced about the lower portions of the dome wall 12. Of course, any number of such matrices 25 could be used to increase the number of lights 22 or other active elements positioned about the dome wall.

As illustrated in FIGS. 1 and 2, a plurality of speakers 33 are positioned about the upper portion of the dome wall to provide audible signals to the player. Each of the four speakers 33 is positioned near one of the four lower matrices 25. As described below, these speakers are used to provide an indication to the player that a light 22 in the associated matrix 25 is about to be lighted. An audible indication that a light 22 associated with the matrix 25 positioned in the upper portion of the dome 11 is to be lighted is provided by activation of all four speakers simultaneously. These audio signals are essential to play of the game because the player cannot view more than a portion of the interior of the dome wall 12 at any given time. Two additional speakers 34 are provided in the dome to provide stereophonic sound effects such as simulated ray gun firing.

Figure 5:
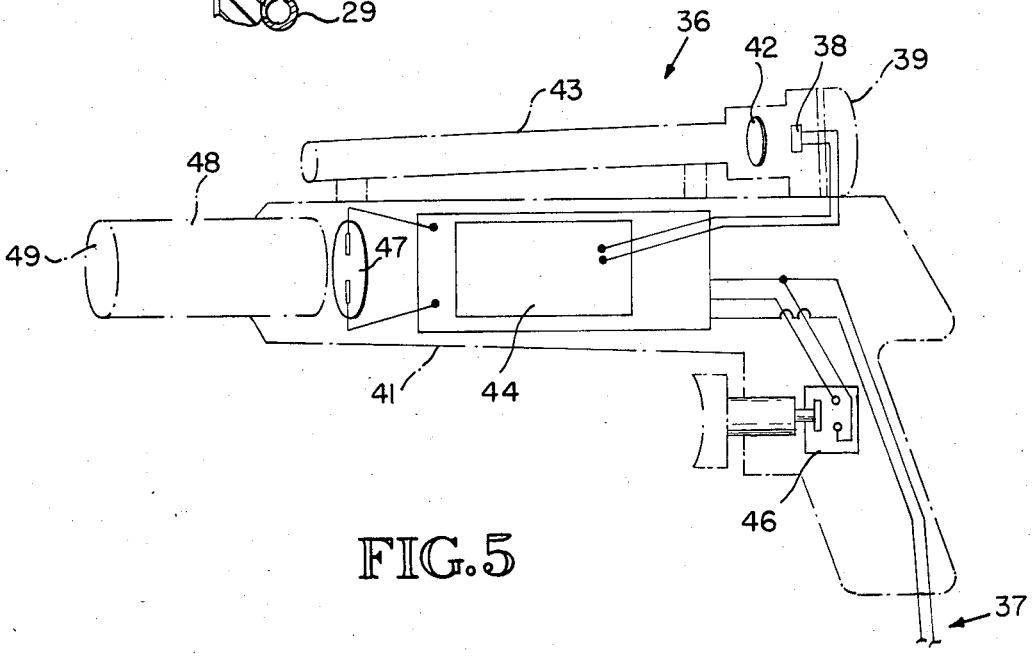
FIG. 5 is a schematic representation of a simulated ray gun usable in the domed game enclosure.

A variety of types of controls may be used by a player within the dome. As illustrated in FIG. 1 and 5, one type of control which may be used is a hand-held simulated ray gun 36. This gun 36 is connected to the control electronics of the game 11 by means of an electrical cable 37. This cable not only transmits signals to the control electronics and provides power to the gun 36 but also prevents removal of the gun 36 from within the game enclosure 11.

The primary function of the gun 36 is to provide a signal indicative of whether the gun 36 has been fired while pointed at an illuminated lamp. To this end, a photosensor 38 is mounted in a housing 39 which is, in turn mounted atop the body 41 of the gun 36. A lens 42 is mounted in front of the photosensor 38 to focus light onto the photosensor. A shield tube 43 extends forward from the housing 39. This tube prevents stray light from reaching the photosensor 38 and, in conjunction with the lens 42, limits the angle by which the gun 36 may be aimed off axis from an illuminated lamp 22 and still allow light from the lamp 22 to reach the photosensor 38. The photosensor 38 is connected to the electronic gun circuitry 44, which is also connected to the trigger switch 46 and the cable 37. The electronic gun circuitry 44 is described below.

Although the random lighting of the lamps 22 in rapid succession provides a spectacular visual effect, a flash tube 47 is mounted within the generally opaque gun body 41 for further effect. This flash tube 47 is controlled by conventional flash tube control electronics 50 which are activated by the trigger switch 44. A cylinder 48 of acrylic plastic or other light conducting material extends away from the flash tube 47 out the front of the gun body 41. When the flash tube 47 is triggered, light is emitted from the front surface 49 of the cylinder 48 as well as through the barrel of the cylinder. This light is reflected off the dome wall to produce a flash effect.

Figure 6:
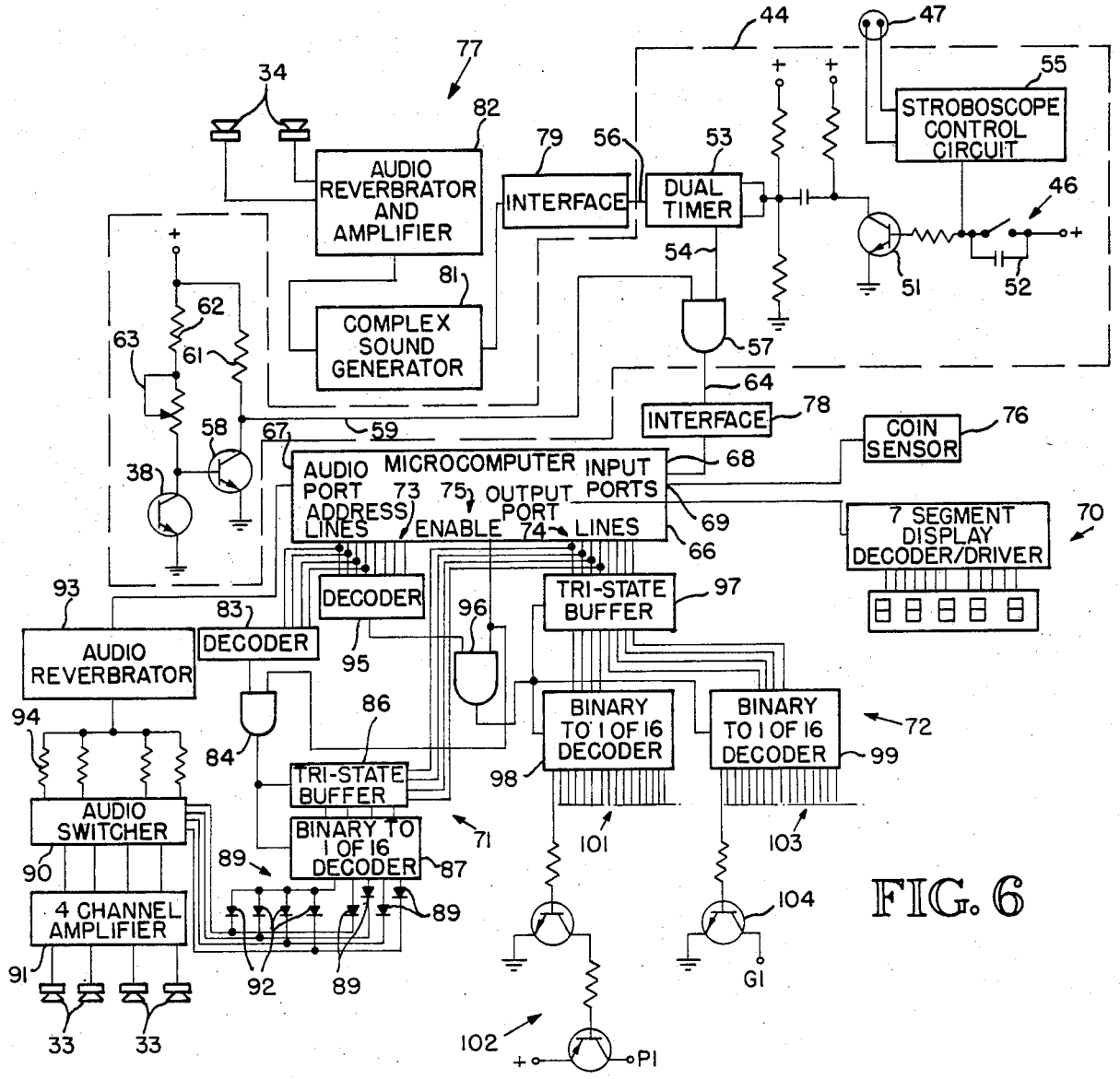
FIG. 6 is an electrical schematic of the control electronics used in connection with the domed game enclosure of FIG. 1.

As illustrated in FIG. 6, the electronic gun circuitry 44 is actuated when the trigger switch 46 is closed. The closing of this switch 46 energizes the base of the transistor 51 which results in a pulse being sent through the capacitor 52 to an integrated circuit dual timer which is wired in one shot mode. That is, when it receives a pulse resulting from the closure of the switch 46 it emits two pulses of independently selected length along its output lines 54, 56. The pulse emitted along the line 54 is transmitted to one input of the AND gate 57.

As set forth above, the photodetector 38 is used to sense whether the gun 36 is aimed at an illuminated lamp. This photodetector 38 controls the base of a transistor 58. When the transistor 58 is in its off state, a positive voltage is supplied to the line 59 through the resistor 61. The base of the transistor 58 is also connected to a positive voltage source through a resistor 62 and a potentiometer 63 and is connected to ground by the photodetector 38. This potentiometer 63 is used to adjust the sensitivity of the paired photodetector 38 and transistor 58.

When the gun is not pointed at an illuminated light 22, the photodetector 38 is nonconductive and a current flows through the resistor 62 and potentiometer 63 to the base of the transistor 58. In such state, the transistor 58 is conductive and a low voltage is maintained on the line 59. When light falls on the photodetector 38 as a result of the gun 36 being pointed at an illuminated lamp 22, the photodetector becomes conductive, lowering the voltage on the base of the transistor 58 until it becomes nonconductive. In such state, a positive voltage is maintained on the line 59 through the resistor 61.

The line 59 is connected to the second of the two inputs of the AND gate 57. Thus, when the trigger is pulled and a positive voltage pulse is applied to the one input of the AND gae along the line 54 and the voltage on line 59 is high as a result of light reaching the photodetector 38 from an illuminated lamp of 22, a positive voltage is output by the AND gate 57. This pulse is transmitted along the cable 37 to the game control electronics.

Every time the trigger switch 46 on the gun 36 is closed, a firing sound must be emitted from the speakers 34. As set forth above, an electronic signal is sent along the signal line 56 each time the trigger switch is closed. This signal is also sent along the cable 37 to sound generating circuitry contained in the game control electronics as described below. In addition, the closing of the trigger switch activates a conventional stroboscope control circuit 55 which in turn activates the flash tube 47 to flash.

The game control electronics control the playing of the game and may be mounted in the base 13 or console 14. As shown in FIG. 6, the game control electronics include a microcomputer system 66. For demonstration purposes, a Texas Instrument 99/4A microcomputer has been used to control the game. Other computers with access to the address and data linse might also be used. The Texas Instrument 99/4A computer includes an audio port 67 which is controlled by the microprocessor of the microcomputer 66 to produce a variety of sounds. When equipped with the proper computer language, such as an enhanced version of the BASIC language, synthesized voice messages can also be produced at the audio port 67.

The microcomputer 66 is also equipped with a plurality of input ports 68. These ports can detect the closure of switches or the transition of a transistor from a nonconductive state to a conductive state.

The microcomputer also includes an output port 69 which may be used to display score information visually. Although the video port of the microcomputer may be used to display the score on a video monitor, preferably one of the other output ports of the microcomputer, such as the printer port, is used. The decoding and display of information on a game display 70 in this manner is known. Audio decoder and driver electronics 71 and decoder and driver electronics for the matrices 25 of lights 22 are connected to the audio port 67 and the address and data lines 73, 74. Score display electronics 70 are connected to the output port 69 and the electronic gun circuitry 44 and a coin sensor 76 are connected to input ports of the microcomputer 66. The remainder of the game electronics comprises the audio circuitry 77 which is not connected to the microcomputer 66 and which is used to generate the gun firing sounds.

As set forth above, when the trigger switch 46 of the electronic gun circuitry 44 is closed pulses are emitted along the signal lines 54, 56. If light is being received by the photodetector 38 of the gun 36, the signal line 59 provides a high signal to one input of the AND gate 57. Since the pulse 54 and the signal on the line 59 are both high, the AND gate 57 outputs a high signal along the line 64 to the interface 78. This interface 78 may comprise a transistor or Darlington pair biased such that a high signal on line 64 trigger it from a nonconductive to a conductive state. Of course, when the pulse emitted by the dual timer along the line 54 becomes low or when the photodetector 38 does not receive light from a lamp 22, the output of the AND gate 57 is low and hence the interface 78 is switched to a nonconductive state.

The other output line 56 of the dual timer 53 also receives a pulse when the trigger switch 46 is closed. This pulse is likewise connected to an interface 79 of similar function to the interface 78. The output of this interface is connected to a complex sound generator integrated circuit 81. Complex sound generators are available which provide a blast sound and can be wired to produce such a sound in a known manner. The audio output of the complex sound generator 81 is fed to a conventional audio reverbrator and amplifier 82 which in turn is connected to the speakers 34. Thus, when the trigger switch 46 is closed, a blast sound is emitted by the speakers 34.

The audio decoder and driver and circuitry 71 is connected to the audio port 67, the address lines 73, the data lines 74, and the memory enable line 74. The purpose of the audio electronics is to produce an audio signal at one or more of the speakers 33 positioned about the domed game enclosure 11. A discreet memory address is assigned to the audio electronic and a decoder 83 is connected in known manner to detect a specific address on the address lines 73. This may be accomplished by use of a series of NAND gates and NOT gates connected such that a specific pattern of high and low electronic signals on the address lines 73 will produce a high output.

The output of the decoder 83 is connected to the input of an AND gate 84. The second input of the AND gate 84 is connected to the memory enable line 75. The output of this AND gate 84 is connected to the enable inputs of a tri-state buffer 86 and a binary to one of 16 decoder 87. The tri-state buffer 86 is connected to the data lines 74 and, when enabled, connects the data lines 74 to the binary to one of 16 decoder 87. When enabled, this decodes the binary data on the data lines 74 and produces a high output on the corresponding one of the 16 output leads.

Only five of the output leads 88 of the one of 16 decoder 87 are used. The first four of these are each connected through a diode 89 to one of the gate inputs of an audio switcher integrated circuit 90.

The fifth output lead 88 of the binary to one of 16 decoder 87 is connected to each of these same gate inputs of the audio switcher 90 by means of four diodes 92.

The audio electronics also includes an audio reverbrator 93 which is connected to the audio port 67 of the microcomputer 66. The output of this reverbrator 93 is connected through a network of resistors 94 to the audio inputs of the audio switcher 90. The four corresponding outputs of the audio switcher 90 are connected to the four audio inputs of a four-channel amplifier 91 which drives the speakers 33.

The lamp decoder and driver electronics 72 function in a manner similar to that of the audio decoder and driver electronics 71. Although only a single lamp driver and decoder electronic circuit is illustrated in FIG. 6, any number of such circuits can be connected to the address lines 73, data lines 74 and memory enable 75 as desired. A separate decode and driver circuit 72 is necessary for each matrix 25 of lights 22.

In this circuitry 72, a decoder 92 is connected to the address lines 73 and, like the decoder 83 is wired to produce a high signal when a specific address, represented by a pattern of high and low signals, is received from the address lines 73.

The output of the decoder 95 is connected to one input of an AND gate 96. The other input of the AND gate 96 is connected to the memory enable line 75. The output of the AND gate 96 is connected to the enable lines of a tri-state buffer 97, and two binary to one of 16 decoders 98, 99. The inputs of the tri-state buffer 97 are connected to the eight data lines 74 of the microcomputer 66. Four of the eight output lines of the tri-state buffer 97 are connected to the first binary to one of 16 decoder 98. The other four output lines of the buffer 97 are connected to the second binary to one of 16 decoder 99.

When the tri-state buffer is enabled, four of the data lines are thus connected to the first binary to one of 16 decoder 98 and the other four the second binary to one of 16 decoder 99. These binary to one of 16 decoders 98, 99 are enabled to receive input from the data lines when the AND gate 96 outputs a high signal and latch to the pattern of signals present on the data lines when the output of the AND gate 96 returns to a low state.

Each of the 16 output leads 101 of the binary to one of 16 decoder 98 is connected to a transistor pair 102 which in turn is connected to one of the power leads of the associated matrix 25, as illustrated in FIG. 7. In like manner, each of the 16 output leads 103 of the second binary to one of 16 decoder 99 is connected to a transistor 104. These transistors 104 are each connected to one of the ground leads of the matrix 25 as shown in FIG. 7. The transistor pair 102 and the transistors 104 are biased such that they are in their conductive state only when the specific lead 101, 103 of the binary to one of 16 decoder is activated.

The audio deocder and driver circuitry functions as follows. When it is desired to activate one of the speakers 33 to produce a tone, the address of the audio circuitry 71 is output by the microcomputer 66 to the address lines 73. The decoder 83 recognizes this address and outputs a high signal to one input of the AND gate 84. Simultaneously, the number assigned to the speaker or speakers to be activated is output on the data lines 74 of the microcomputer 66 and the memory enable 75 outputs a high signal. The signal from the memory enable is connected to the other input of the AND gate 84. Thus, the AND gate 84 outputs a high signal which enables the tri-state buffer 86 and binary to one of 16 decoder 87. When the tri-state buffer 86 is enabled by the output of the AND gate 84, the binary to one of 16 decoders 87 receives the signals on the data lines 74 of the microcomputer. These signals are decoded to energize one of the 16 output leads 88 of the binary to one of 16 decoder 87. If the activated lead 88 is one of those connected to only a single diode 89, then one of the four channels of the audio switcher will be energized. If the energized lead 88 is the one connected to the four diodes 92 then all four of the channels of the audio switcher 91 are activated. If the lead 88 energized is other than one of these leads, then all channels of the audio switcher are set to their inactive state.

The memory enable line 75 of the microcomputer 66 remains active for only a short period of time. When this lead 75 is de-energized, the AND gate 84 ceases to output a high signal which results in the deactivation of the tri-state buffer 86 and the binary to one of 16 decoder 87. However, since the binary to one of 16 decoder 87 latches when it ceases to receive an enable signal from the AND gate 84, the output leads 88 remain energized even after the enable line 75 has ceased to output a high signal. The data on the address lines 73 and the data lines 74 can then be changed without disturbing the state of the binary to one of 16 decoder 87 and hence the state of the audio switcher 90. Once the state of the audio switcher 90 has been set, the microcomputer 66 may output an audio signal from the audio port 67. This audio signal passes through the audio reverbrator 93 which imparts a hollow, erie sound quality thereto. The output of the audio reverbrator 93 is divided among the four inputs of the audio switcher circuit 90 through four resistors 94. If the state of the audio switcher 90 is such that none of its channels are activated, the audio switcher 91 blocks any audio signal. If, however, one or more of the channels of the audio switcher are activated, then the audio signal from the microcomputer is passed to the corresponding input or inputs of the four channel amplifier 91 where it is amplified and fed to the appropriate speaker or speakers 33.

The light decoder and driver circuitry 72 functions in a manner similar to that of the audio decoder and the driver circuitry 71. The decoder 95 of the light decoder and driver circuitry 72 is connected to the address lines 73 of the microcomputer 66. This decoder 95, like the decoder 83 of the audio decoder and driver circuitry is wired to recognize a specific pattern of high and low signals on the address line 73 and to output a high signal when the address of the matrix 25 is present on the address lines 83. The output of the decoder is connected to one input of an AND gate 96. The other input of the AND gate 96 is connected to the memory enable line 75 of the microcomputer. When the proper address is present on the address lines 73 and the memory enable line 75 is energized, the AND gate 96 outputs a high signal to the tri-state buffer 97 and to each of the binary to one of 16 decoders 98, 99. Four bits of data are then transmitted through the tri-state buffer 97 from the data lines 74 to each of the binary to one of 16 decoders 98, 99.

The memory enable line 75 remains high for only a brief period. When it returns to its low state, the AND gate 96 ceases to output a high enable signal to the binary one of 16 decoders 98, 99 and the tri-state buffer 97. The binary to one of 16 decoders then each latch the four bits of data which were input to them. The signals on the address lines 73 and data lines 74 may then be changed without altering the output of the binary to one of 16 decoders 98, 99.

Each of the binary to one of 16 decoders has 16 discreetly energizable output leads 101, 103. These decoders 98, 99 translate the four bits of binary information input to them and each energize one of the 16 leads 101, 103. In the case of the first binary to one of 16 decoder 98, the energizing of one of the leads 101 results in the energizing of the associated transistor pair 102. A positive voltage is thus applied to the associated horizontal strip of connective material 24. The energizing of one of the leads of the other binary decoder 99 results in activation of the associated transistor 104 which grounds the associated vertical strip of conductive material 23.

As illustrated in FIG. 7, when power is supplied to, for example, the second horizontal strip 24 at the point P2 and the second vertical strip is grounded at the point G2, current flows from the point P2 through the light 22 and diode 32 which are associated with both the second power and second ground strips 23, 24 and flows from there through the point G2 and to ground. The diodes 32 associated with each of the lights 22 prevents current flow to ground through other than this path.

Since there are 16 power supplying transistor pairs 102 and 16 grounding transistors 104 a total of 256 lights 22 may be connected between 16 vertical strips of conductive material and 16 horizontal strips of conductive material in an array. One of the lights 22, however, is eliminated from the array so that, by providing the address of this lamp to the binary to one of 16 decoders may, 99, all lights 22 in the array can be extinguished.

Figure 8:
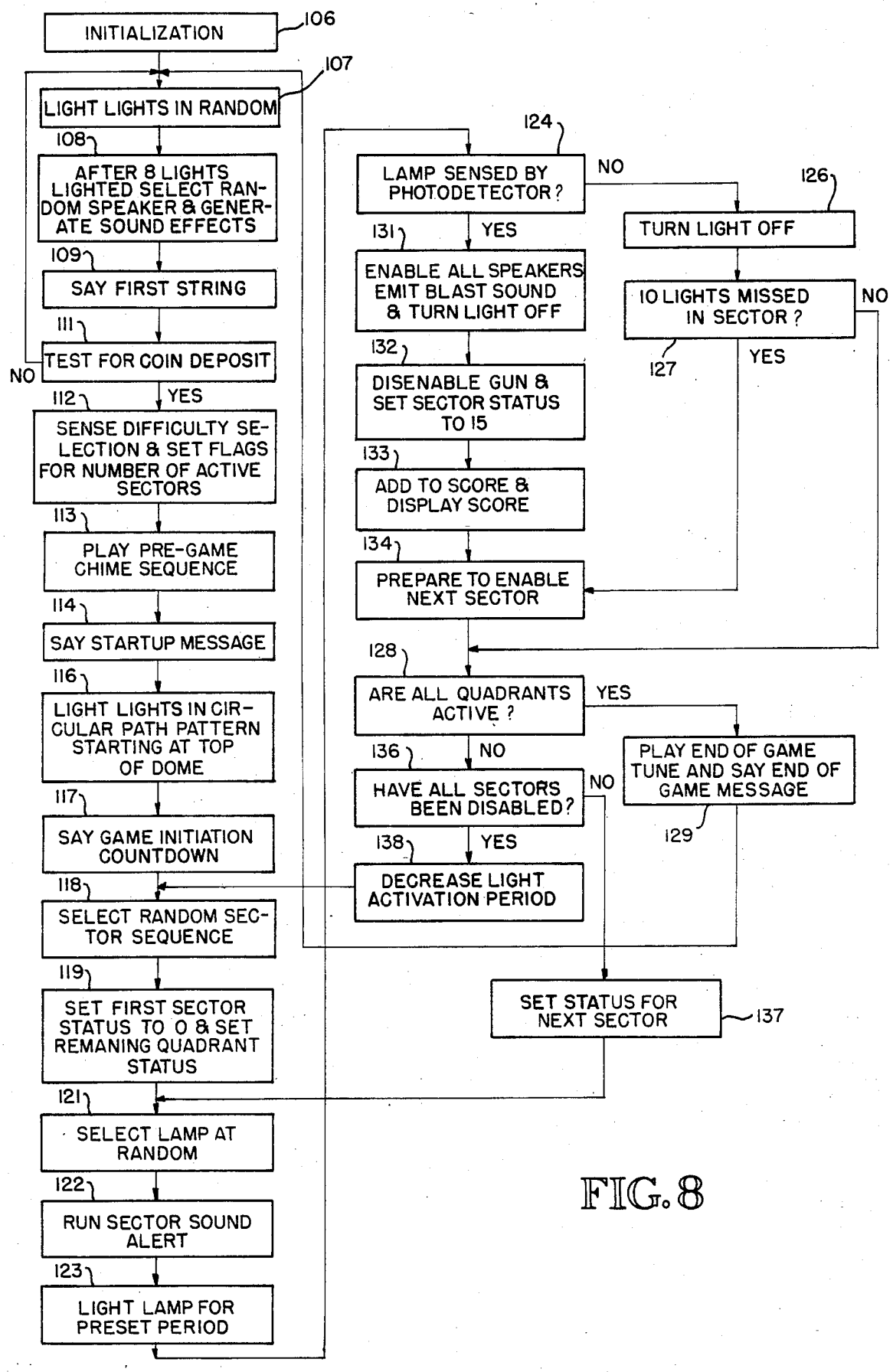
FIG. 8 is a flow diagram of a game control program for use with the microcomputer of FIG. 6.

As set forth above, the game is played under control of the microcomputer 66. The microcomputer 66, in turn is subject to a control program. As illustrated in FIG. 8, the first step 106 of the computer program is that of initialization. In this step, values are stored to various counters as necessary to keep track of the function of the program. In the next step 107, the attract mode of the game is begun. In this step 107 the microcomputer 66 generates random numbers and, in response to these numbers, lights a randomly selected light 22 in a randomly selected matrix. This step 107 is repeated until eight lights have been randomly lighted at which time the next step 108 is executed.

In this step 108, one of the four speakers 33 is selected at random and a tone or blast sound is produced. The microcomputer 66 then executes the next step 109 in which the voice synthesis capabilities of the microcomputer are used to say a first sentence. This sentence may comprise a challenge to prospective players and may be selected at random from a set of available character strings.

At this point 111, the microcomputer checks the input port 68 to determine if a coin has been deposited as indicated by the coin sensor 76. If not, the microcomputer returns to the step 107 of lighting the lights in a random sequence and continues with the remaining steps 108–111 of the attract mode sequence. If a coin has been deposited, however, the computer sets the difficulty level selected by the player and sets flags to indicate the maximum number of sectors which may be activated. For demonstration purposes, the level of difficulty can be entered on the microcomputer keyboard. Buttons could also be provided on the console 14 and connected to the input ports 68 which buttons would be monitored by the microcomputer for selection of a difficulty level.

The computer then executes the first step 113 of the pre-game sequence. This sequence commences by the playing of a pre-game chime sequence. This is accomplished by selecting one or all of the speakers 33 and outputting a tone sequence through the audio port 67.

In the next step 114 the voice synthesis capabilities of the microcomputer 66 are used to output a voice message through the audio port to one or more of the speakers 33. Again this message may be randomly selected and may comprise encouragement or challenges to the player. The microcomputer 66 then addresses the one of the matrices 25 to light all of the lights 22 in a circular patterns starting at the top of the dome and descending to the bottom. The microcomputer then enables the audio decoder driver electonics 71 once again and synthesizes a game initiation countdown. This countdown is output through the audio port to the speakers 33. This step 117 concludes the pre-game sequence.

The microcomputer 66 next executes the steps 118, 119 of selecting one of the matrices 25 at random and setting the status variable associated with the quadrant in which this matrix 25 is located to zero. The computer then selects one of the lamps in this array at random. In the next step 122, if the selected matrix is one of the four mounted about the lower periphery of the wall 112 the computer selects the speaker 33 which is associated with the selected matrix 25. If the randomly selected sector to be activated is that corresponding to the matrix 25 on the ceiling on the dome 12, all four speakers 33 are activated. The microcomputer 66 then outputs a tone of increasing loudness. When this tone has reached a predetermined loudness, the selected light 22 is lighted for a predetermined period and the input port 68 interfaced to the electronic gun circuitry is monitored to determine if the photodetector 38 is pointed at this light 22 when the trigger switch is closed. If not, at the end of the predetermined illumination period, the computer executes the step of turning the light off by outputting the number on the data lines 66 of the nonexistent light 22 which is not present in the array.

The computer then executes the next step 127 of checking the sector counter to determine if ten lights 22 in the sector have been lighted in succession without any of them having been sensed by the gun control circuitry 36. If ten lights 22 have not been missed since activation of the sector, the computer next executes the step 128 of determining if all matrices 25 are active. This is accomplished by checking to see if the status of all sectors has been set to zero.

If so, the next step 129 is the activation of the audio decoder and driver circuitry and the playing of an end of game tune through one or more of the speakers 33. The microcomputer then uses its voice synthesis capability to say an end of game message which again may be selected at random and may rank the player according to his performance and offer congratulations or may encourage the player to try again.

The microcomputer 66 then returns to the attract mode sequence commencing with the step 107 of lighting the lights in random fashion.

If, in the step 124 the gun was fired while pointed at the illuminated lamp 22, the audio decoder driver circuitry is energized and all four channels are enabled. The microcomputer then uses its sound synthesis capability to emit a blast sound and turns the light off. The microcomputer 66 then disenables the gun 36 by ceasing to monitor the associated input port. The sector which corresponds to the active matrix 25 is then disenabled by storage of the number 15 to the associated status variable. The status of all of the sectors corresponding to the matrices 25 is then checked. If all of them are in their disabled states, the variable which determines the amount of time during which a lamp 22 is illuminated is decreased. In the next step 133 a predetermined value is added to the score and this score is displayed on the game display 70. The computer then executes the next step 134 of preparing to enable the next sector and thus to illuminate a light in the associated matrix of lamps 22.

The status value stored in the status variables of each quadrant is periodically decremented from 15 until it reaches the number one at which point no further periodic decrementing is undertaken. All sectors with a status value of one are available for selection. When no sectors are active and none is in the process of being enabled, the variable which determines the length of time a lamp 22 remains lighted is decreased so that the game proceeds more rapidly.

In the process of enabling the sector, the status variable associated with that sector is set to zero. In the event that the player missed the lamp in step 124, and 10 lights in the array corresponding to the active sector have been missed, the microcomputer 66 also prepares to enable the next sector. Of course, if no sector is available to be enabled because the status variable associated with all the inactive quadrants has a value greater than one, no sector is prepared for enabling in this step 134 until a sector is available for enabling.

The microcomputer 66 next executes the step 128 of determining if all quadrants are active and if not continues the game with the step 136 of determining if all sectors have been disabled. If all sectors have not been disabled the step 137 of setting the status of the sectors is then executed as necessary. If it is time for the periodic decrementing of the value of the status variables, the computer checks the status variables associated with each sector and decreases the value of each such variable unless such variable has been decremented to one or zero. The computer then returns to the step 121 of selecting a lamp to be illuminated and continues with the game.

If, however, in the step 136 all sectors have been disabled, the computer executes the step 137 of decreasing the period during which the lights 22 is active. This is accomplished by decreasing the value of the variable used to determine the time for which the lights 22 are illuminated. Since the player has thus successfully disabled all of the sectors, a new game series may be begun. The microcomputer 66 thus returns to the step of selecting a random sector sequence to determine the order in which the sectors will be activated and continues as described above until the player losses. A loss by the player occurs when all five matrices 25 are active at the same time.

It will be understood that the invention may be embodied in other specific forms without departing from the spirit or central characteristics thereof. The embodiments of the invention described above are to be considered as illustrative and not restrictive. The invention is thus not to be limited to the details given herein but may be modified within the scope of the appended claims.

We claim:

1. An electronic game apparatus including a plurality of electrically energizable target elements and player operable target detecting means for detecting when a target element is energized and said detecting means is aimed thereat, comprising:

means forming an enclosure of sufficient dimension to enclose a person therewithin;

a plurality of active elements arranged on a plurality of matrices and mounted at spaced locations on the inner surface of said enclosure wherein each of said matrices is of a dimension at least two by two and comprises a plurality of elongated, intersecting conductors mounted to said enclosure, said elements comprising said target elements and being selectively energizable for providing a visual signal to a person positioned in said enclosure;

optical sensing means comprising said target detecting means for producing an electrical signal in response to a visual signal generated by an energized active element; and control means connected to said active elements and adapted to receive a signal from said means for producing an electrical signal for controlling selective activation of said active elements and monitoring said electric signal generating means to detect sensing of said visual signal thereby.

2. The apparatus of claim 1 wherein said control means include a microcomputer.

3. The apparatus of claim 1 wherein said active elements comprise means for emitting light in response to application of electrical power thereto.

4. The apparatus of claim 3 wherein said light emitting means being associated with said conductors such that the total number of light emitting means in each said matrix exceeds the total number of conductors therein.

5. The apparatus of claim 4 wherein said means forming an enclosure includes a wall of generally non-conductive material for supporting said conductors and wherein said conductors are divided into two sets, said first set of conductors being mounted adjacent one surface of said wall being spaced a generally uniform distance from one another and said second set of conductors being mounted adjacent a second surface of said wall in overlapping relation with said first set, said conductors extending generally transversely to the conductors of said first set.

6. The apparatus of claim 5 wherein said active elements comprise means for emitting light, each such light emitting means being connected between one conductor of said first set and one conductor of said second set.

7. The apparatus of claim 4 wherein said plurality of matrices are arranged on the inner surface of said enclosure for substantially surrounding with active elements a person within said enclosure.

8. The apparatus of claim 1 further comprising means contolled by said control means and operatively associated with said means forming an enclosure for generating an acoustic signal audibly locatable by a person positioned in said enclosure.

9. The apparatus of claim 8 wherein said control means is adapted to control said acoustic signal generating means to produce an acoustic signal locatable proximate to an active element and to selectively activate said active element in conjunction with the producing of said acoustic signal.

10. The apparatus of claim 9 wherein said enclosure is in the form of a dome.

11. The apparatus of claim 10 wherein said enclosure is mounted on a base whereby the shape of said enclosure is maintained.

12. The apparatus of claim 1 wherein said means forming an enclosure comprises a plurality of panels of generally transparent material joinable to form said enclosure.

13. The apparatus of claim 12 wherein said panels are joinable such that a dome shaped enclosure is formed.

14. The apparatus of claim 13 wherein said active elements comprise means for emitting light in response to application of electrical power thereto, each said matrix comprising a plurality of conductors mounted to said enclosure, said light emitting means being associated with said conductors such that the total number of light emitting means in each said matrix exceeds the total number of conductors therein.

15. The apparatus of claim 14 further comprising means operatively associated with said means forming an enclosure and controlled by said control means for generating an acoustic signal audibly locatable by a person positioned in said enclosure, said control means being adapted to control said acoustic signal generating means to produce an acoustic signal locatable proximate to an active element and to selectively activate said light emitting means in conjunction with the producing of said acoustic signal.

16. The apparatus of claim 15 wherein said plurality of matrices are arranged on the inner surface of said enclosure for substantially surrounding with active elements a person within said enclosure.

17. The apparatus of claim 15 wherein said means for producing an electrical signal in response to said visual signal further comprises light sensing means for detecting light emitted by said light means;

switch means for generating a second electrical signal; and means connected to said light sensing means and said switch means for generating said electrical signal in response to reception of said second electrical signal and to detection of light by said light detecting means.

18. The apparatus of claim 17 wherein said control means is adapted to control the period during which said active elements are energized and to decrease said period in response to generation of said signal by said signal generation means.

* * * * *